US005220392A

United States Patent [19]

Akiyama

[11] Patent Number: 5,220,392

[45] Date of Patent: Jun. 15, 1993

[54] ELECTROPHOTOGRAPHIC PRINTER

[75] Inventor: Keiichi Akiyama, Tamayama, Japan

[73] Assignee: Alps Electric Co., Ltd., Tokyo, Japan

[21] Appl. No.: 890,994

[22] Filed: May 29, 1992

[30] Foreign Application Priority Data

Jun. 12, 1991 [JP] Japan ..... 3-139356

[51] Int. Cl.[5] ..... G03G 21/00

[52] U.S. Cl. ..... 355/305; 355/219; 355/296

[58] Field of Search ..... 355/296, 298, 301, 303, 355/305, 219, 221; 15/256.51, 256.52

[56] References Cited

U.S. PATENT DOCUMENTS

| | | | |
|---|---|---|---|
| 4,355,886 | 10/1982 | Perez et al. | 355/305 |
| 4,427,289 | 1/1984 | Oda | 15/256.51 X |
| 4,477,174 | 10/1984 | Haneda et al. | 355/253 |
| 4,545,669 | 10/1985 | Hays et al. | 355/253 |
| 4,571,071 | 2/1986 | Bothner | 355/298 |
| 4,601,569 | 7/1986 | Garris | 355/305 |
| 4,664,504 | 5/1987 | Oda et al. | 355/297 |
| 4,671,641 | 6/1987 | Kohyama | 355/305 X |
| 4,849,785 | 7/1989 | Tanabe | 355/298 X |
| 5,126,799 | 6/1992 | Matsuura et al. | 355/298 |

FOREIGN PATENT DOCUMENTS 61-132634 6/1986 Japan .

*Primary Examiner*—Leo P. Picard

*Assistant Examiner*—Christopher Horgan

*Attorney, Agent, or Firm*—Guy W. Shoup; Patrick T. Bever

[57] ABSTRACT

The invention provides an electrophotographic printer wherein a toner unit and the entire apparatus can be reduced in size and the degree of freedom in designing can be achieved and besides possible deterioration of a photosensitive member can be prevented with certainty. A toner unit (3) in which toner power (2) is stored is disposed in the proximity of an outer periphery of a photosensitive belt (13) mounted for rotation. An LED head (5) is disposed on the rear face side of the photosensitive belt (13) while a developing roll (6) for causing toner power (2) to adhere to an electrostatic latent image to form a visible toner image and a cleaning roll (17) for removing and recovering remaining toner powder (2) of the photosensitive belt (13) are disposed in the toner unit (3). The cleaning roll (17) is formed from a magnet roll (18) and a sleeve (19) covering over an outer periphery of the magnet roll (18). The magnet roll (18) and the sleeve (19) are driven to rotate in the opposite directions to each other, whereupon a magnetic brush is formed. The magnetic brush attracts remaining toner powder (2) on the surface of the photosensitive belt (13) thereto and charges the surface of the photosensitive belt (13) after removal of the remaining toner powder (2) uniformly to a potential with charge.

14 Claims, 4 Drawing Sheets

ELECTROPHOTOGRAPHIC PRINTER

BACKGROUND OF THE INVENTION

1. Field of the Invention

This invention relates to an electrophotographic printer, and more particularly to an electrophotographic printer of the type wherein a toner powder image electrostatically adhering to a photosensitive member is transferred to paper to effect desired printing.

2. Description of the Prior Art

Various electrophotographic printers are known. An exemplary one of conventional electrophotographic printers is shown in FIG. 7. Referring to FIG. 7, a cylindrical photosensitive member 1 is disposed for rotation in the inside of a printer body not shown. A toner unit 3 having a substantially L-shaped cross section is disposed adjacent an outer periphery of the photosensitive member 1 such that the opposite ends thereof are positioned in the proximity of the outer peripheral face of the photosensitive member 1, and toner powder 2 is accommodated in the photosensitive member 1. A charger 4 for applying charge uniformly to a surface of the photosensitive member 1 by corona discharge to put the photosensitive member 1 into a write-enabled condition and an LED (light emitting diode) head 5 serving as an optical writing head for forming an electrostatic latent image on the semiconductor layer 1 in response to a printing signal are disposed in this order between the photosensitive member 1 and the toner unit 3. A developing roll 6 for applying toner power 2 of the toner unit 3 to an electrostatic latent image written by the LED head 5 to form a visible toner image is disposed in the toner unit 3 on the downstream side of the LED head 5 in the direction of rotation of the photosensitive member 1. A cleaning blade 7 for removing remaining toner powder 2 sticking to the surface of the photosensitive member 1 and recovering it into the toner unit 3 is disposed in the toner unit 3 on the upstream side of the charger 4 in the direction of rotation of the photosensitive member 1. A plurality of transport paddles 8 for feeding toner power 2 accommodated in the toner unit 3 toward the developing roll 6 is disposed in the toner unit 3.

transfer unit 10 in the form of a corona discharger for transferring a visible toner image developed by the developing roll 6 to a predetermined paper sheet 9 is disposed adjacent the photosensitive member 1 between the developing roll 6 and the cleaning blade 7.

In the conventional electrophotographic printer described above, the photosensitive member 1 is first put into a write-enabled condition by the charger 4, and then an electrostatic latent image is formed on the photosensitive member 1 in response to a printing signal by the LED head 5. Then, toner powder 2 accommodated in the toner unit 3 and fed by the transport paddles 8 is supplied to the photosensitive member 1 so that it may adhere to the electrostatic latent image formed on the photosensitive member 1 to form a visible toner image. After then, the toner image is transferred by the transfer unit 10 to a paper sheet 9 which is transported between the photosensitive member 1 and the transfer unit 10. After then, the paper sheet 9 is exfoliated from the photosensitive member 1, and the toner image is fixed to the paper sheet 9 by a fixing unit not shown, thereby completing desired printing.

Meanwhile, remaining toner powder 2 on the photosensitive member 1 is removed by the cleaning blade 7 to put the photosensitive member 1 into a chargeable condition again, and the toner powder 2 removed from the cleaning blade 7 is recovered into the toner unit 3, in which it is thereafter stored for the re-utilization.

In the conventional electrophotographic printer, however, the charger 4 and the LED head 5 must be disposed between the developing roll 6 and the cleaning blade 7 which are both disposed in the toner unit 3, and to this end, the toner unit 3 must necessarily be shaped such that it extends over the rear sides of the charger 4 and the LED head 5. Consequently, the toner unit 3 generally has a great overall size. Besides, the removing or mounting direction of the toner unit 3 upon replacement is limited by the charger 4 and/or the LED head 5, which provides a very limited degree of freedom in designing.

Moreover, since the toner unit 3 has such a profile that it extends over the rear sides of the charger 4 and the LED head 5, ozone gas generated from the charger 4 and heat generated from the LED head 5 are confined between the toner unit 3 and the photosensitive member 1, which deteriorates the photosensitive member 1 remarkably and gives rise to reduction in life of the photosensitive member 1. In addition, since the gap between the toner unit 3 and the photosensitive member 1 is small, cleaning of the surfaces of the charger 4 and the LED head 5 is very difficult.

SUMMARY OF THE INVENTION

It is an object of the present invention to provide an electrophotographic printer wherein a toner unit and the entire apparatus can be reduced in size and the degree of freedom in designing can be enhanced.

It is another object of the present invention to provide an electrophotographic printer wherein possible deterioration of a photosensitive member can be prevented with certainty.

In order to attain the objects, according to the present invention, there is provided an electrophotographic printer, which comprises a printer body, a photosensitive member disposed for rotation in the printer body, a toner unit disposed in the proximity of an outer periphery of the photosensitive member and having toner powder stored therein, a developing roll disposed in the toner unit for supplying toner powder to a surface of the photosensitive member so that the toner powder may adhere to an electrostatic latent image formed on the surface of the photosensitive member to form a visible toner image, a cleaning mechanism for removing and recovering remaining toner powder on the surface of the photosensitive member, and an optical writing head disposed on the rear face side of the photosensitive member between the developing roll and the cleaning mechanism for forming an electrostatic latent image on the photosensitive member in response to a printing signal, the cleaning mechanism including a cleaning roll which acts to form thereon a magnetic brush to attract remaining toner powder on the surface of the photosensitive member thereto and also to charge the surface of the photosensitive member after removal of the remaining toner powder uniformly to a potential with charge.

In the electrophotographic printer, a magnetic brush is formed on the cleaning roll and attracts remaining toner powder on the photosensitive member thereto to recover the toner powder. The surface of the photosensitive member from which the toner powder has been removed is charged uniformly by the magnetic brush so that the photosensitive member is put into a condition in which it can be written by the optical writing head. Consequently, a separate charger is unnecessary. Besides, since the optical writing head is disposed on the rear face side of the photosensitive member, reduction in size of the toner unit and the entire apparatus can be achieved and besides the removing or mounting direction of the toner unit upon replacement is not limited, by which enhancement of the degree of freedom in designing can be achieved. Further, possible deterioration of the photosensitive member by ozone gas generated from a charger and heat generated from the optical writing head can be prevented with certainty.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENTS

Figure 2:
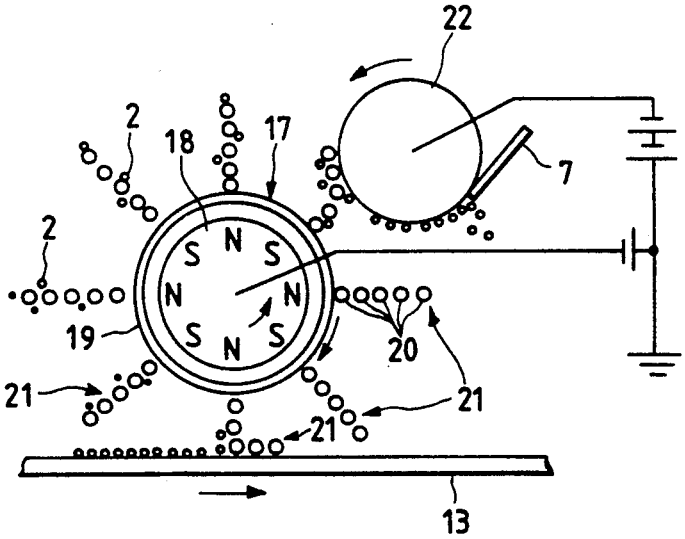
FIG. 2 is a schematic view showing remaining toner powder on a magnetic brush being attracted by a magnetic brush on a cleaning roll of the electrophotographic printer of FIG. 1.
Figure 3:
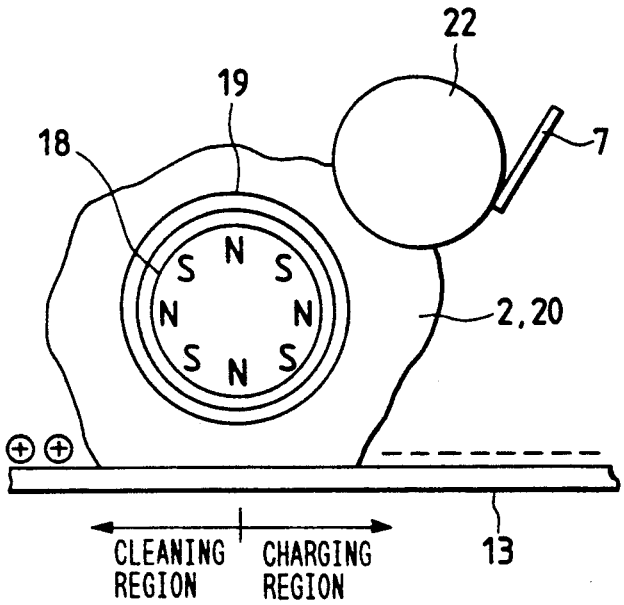
FIG. 3 is a schematic view illustrating an attracted condition of remaining toner powder by a cleaning roll and a charged condition of a photosensitive belt of the electrophotographic printer of FIG. 1.
Figure 4:
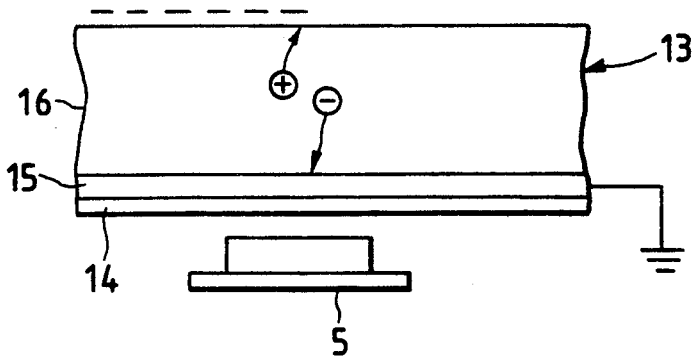
FIG. 4 is a schematic view illustrating formation of an electrostatic latent image in the photosensitive belt by an LED head of the electrophotographic printer of FIG. 1.

Referring first to FIGS. 1 to 4, there is shown an electrophotographic printer according to a first preferred embodiment of the present invention. The electrophotographic printer shown includes a printer body 11 and a photosensitive belt 13 disposed in the printer body 11 and extending between a pair of driving rollers 12. Referring particularly to FIG. 4, the photosensitive belt 13 includes a base film 14 and a photosensitive material 16 layered on a surface of the base film 14 with a transparent electrode 15 interposed therebetween.

Figure 1:
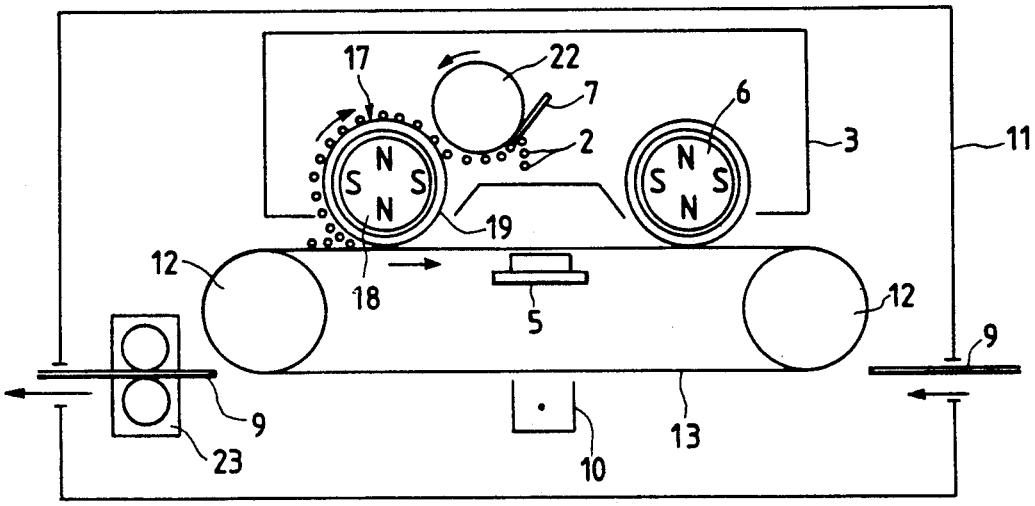
FIG. 1 is a schematic view of an electrophotographic printer showing a first preferred embodiment of the present invention.

Referring to FIG. 1, an LED head 5 serving as an optical writing head is disposed at an upper position in the inside, that is, on the inner periphery side, of the photosensitive belt 13 such that it normally contacts with an inner periphery of the photosensitive belt 13. Light emitted from the LED head 5 is irradiated upon the photosensitive blet 13 from the inner face side so that an electrostatic latent image may be formed on the photosensitive belt 13.

A toner unit 3 in which toner powder 2 is accommodated is disposed above the photosensitive belt 13. A developing roll 6 for supplying toner powder 2 to the photosensitive belt 13 so as to adhere to an electrostatic latent image written by the LED head 5 to form a visible toner image is disposed in the toner unit 3 on the downstream side of the LED head 5 in the transporting direction of the photosensitive belt 13 such that it is positioned in the proimity of the outer peripheral face of the photosensitive belt 13. A cleaning roll 17 serving as a cleaning mechanism for removing remaining toner powder 2 sticking to the surface of the photosensitive belt 13 to recover it into the toner unit 3 is disposed in the toner unit 3 on the upstream side of the LED head 5 in the transporting direction of the photosensitive belt 13 such that it is positioned in the proximity of the outer peripheral face of the photosensitive belt 13. Referring to FIG. 2, the cleaning roll 17 is constituted from a magnet roll 18 to which a fixed voltage is applied, and a non-magnetic cylindrical sleeve 19 covering over the outer periphery of the magnet roll 18. The magnet roll 18 and the sleeve 19 can be driven to rotate in arbitrary directions independently of each other, and when the magnet roll 18 and the sleeve 19 are driven to rotate in the opposite directions to each other, a magnetic brush 21 is formed from magnetic carrier particles 20 on the outer peripheral face of the sleeve 19.

A recovery roller 22 made of a metal is disposed for rotation in the proximity of the cleaning roll 17, and a voltage higher than the voltage applied to the magnet roll 18 is applied to the recovery roller 22. A cleaning blade 7 for scraping off toner powder 2 sticking to the outer peripheral face of the recovery roll 22 is disposed on the outer periphery of the recovery roll 22.

A transfer unit 10 in the form of a corona discharger for transferring a visible toner image developed by the developing roll 6 to a predetermined paper sheet 9 is disposed below the photosensitive belt 13.

In operation, when remaining toner powder 2 on the photosensitive belt 13 is to be recovered, the magnet roll 18 and the sleeve 19 of the cleaning roll 17 are driven to rotate in the opposite directions to each other as indicated by arrow marks in FIG. 2, and, for example, where the toner powder 2 used is of the positively chargeable type, a negative bias voltage is applied to the magnet roll 18 of the cleaning roll 17. Consequently, a magnetic brush 21 is formed on the outer peripheral face of the sleeve 19 of the cleaning roll 17 such that it is turned by rotation of the sleeve 19 and has an end portion which contacts with the surface of the photosensitive belt 13 and the toner powder 2, and the magnetic brush 21 is charged with negative charge. Then, due to the negative charge of the magnetic brush 21, Coulomb's force acts upon the toner powder 2 in the positively charged condition, and consequently, toner powder 2 remaining on the photosensitive belt 13 is attracted to magnetic carrier particles 20 forming the magnetic brush 21, thereby performing cleaning of the photosensitive belt 13. In this instance, where the toner powder 2 is magnetic toner powder, also magnetic attracting force of the carrier particles 20 acts to attract the remaining toner powder 2.

Then, the toner powder 2 attracted to the sleeve 19 of the cleaning roll 17 is turned while being held by the magnetic brush 21 of the cleaning roll 17, and consequently, it is thereafter attracted to the recovery roll 22 to which a voltage higher than the voltage applied to the magnet roll 18 is applied. After then, the toner powder 2 is scraped off by the cleaning blade 7 and drops into the toner unit 3 so that it is thereafter stored in the toner unit 3.

Meanwhile, the surface of the photosensitive belt 13 from which the toner powder 2 has been removed is charged with negative charge when it is contacted by carrier particles 20 charged with negative charge as shown in FIG. 3. Consequently, at portions of the cleaning roll 17 and the photosensitive belt 13 at which they are positioned in the proximity of each other, two regions including a cleaning region in which toner powder 2 charged with positive charge is removed by carrier particles 20 of the cleaning roll 17 and another charging region in which the photosensitive belt 13 is charged uniformly to a negative potential by carrier particles 20 after removal of the toner powder 2 therefrom are formed. As a result, the cleaning roll 17 functions as a charger, which eliminates the necessity of such an independent charger as in a conventional electrophotographic printer.

When desired printing is to be performed, the surface of the photosensitive belt 13 is charged uniformly with negative charge by the cleaning roller 17, and then the LED head 5 is operated in response a predetermined printing signal so that light is irradiated upon the photosensitive belt 13 from the rear face side. Consequently, an electrostatic latent image is formed on the photosensitive belt 13. Formation of a latent image by such irradiation of light is performed such that, when light from the LED head 5 is irradiated upon the photosensitive belt 13 from the rear face side, carrier pairs of holes and electrons are generated at the irradiated portion of the photosensitive belt 13, and the holes are coupled to negative charge at the surface of the photosensitive material 16 to neutralize the charge of the electrode as seen from FIG. 4.

Then, toner powder 2 stored in the toner unit 3 is supplied to the photosensitive belt 13 so that it may adhere to the negative charge portion of the electrostatic latent image formed on the photosensitive belt 13 to form a visible toner image. After then, the toner image is transferred by the transfer unit 10 to a predetermined paper sheet 9 which is transported between the photosensitive belt 13 and the transfer unit 10. After then, the paper sheet 9 is exfoliated from the photosensitive belt 13, and the toner image is fixed to the paper sheet 9 by a fixing unit 23 to effect desired printing.

Accordingly, in the electrophotographic printer of the present embodiment, since the LED head 5 is disposed on the inner periphery side of the photosensitive belt 13 and the cleaning roll 7 functions also as a charger, such a charger as is necessitated in conventional electrophotographic printers is not necessary, and consequently, it is not necessary to dispose both of a charger and the LED head 5 between the toner unit 3 and the photosensitive belt 12. Consequently, the electrophotographic printer is reduced in size. Besides, the toner unit 3 need not be shaped such that it extends over the rear sides of a charger and the LED head 5, and consequently, the toner unit 3 is reduced in size. Furthermore, since a roll for cleaning and charging and another roller for development are formed as separate rolls, cleaning, charging and developing steps can be performed smoothly and with certainty and high speed printing can be realized.

Further, since a charger is unnecessary and the LED head 5 is disposed on the rear face side of the photosensitive belt 12, the removing or mounting direction of the toner unit 3 upon replacement is not limited and consequently, the degree of freedom in designing can be enhanced remarkably. Furthermore, otherwise possible deterioration of the photosensitive belt 13 which may be caused by ozone gas generated by a charger and/or by heat generated by the LED head 5 can be prevented with certainty and the life of the photosensitive belt 13 can be enhanced remarkably. In addition, since the LED head 5 or the like is not disposed between the toner unit 3 and the photosensitive belt 13, cleaning of the surface of the LED head 5, maintenance of the LED 5 and so forth can be performed very readily.

Figure 5:
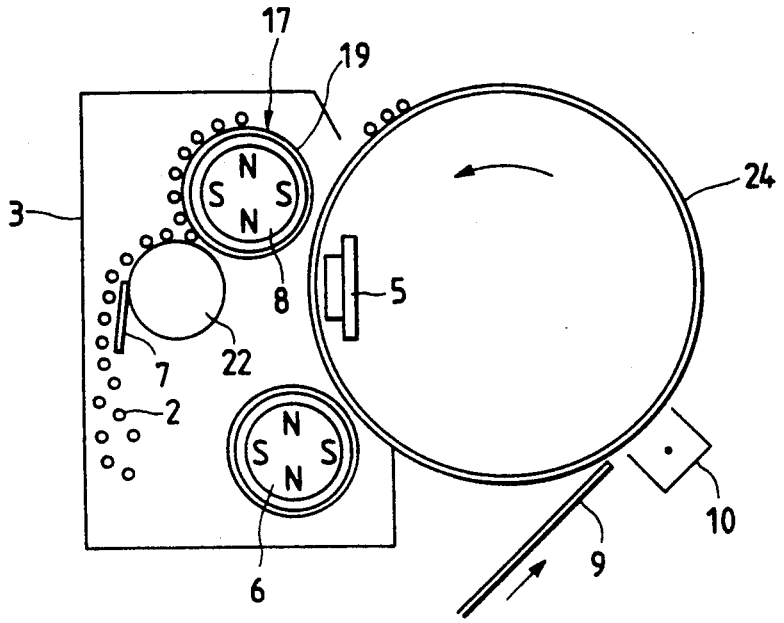
FIG. 5 is a schematic view of another electrophotographic printer showing a second preferred embodiment of the present invention.

Referring now to FIG. 5, there is shown another electrophotographic printer according to a second preferred embodiment of the present invention. The present electrophotographic printer includes, as a photosensitive member, a hollow photosensitive drum 24 in place of the photosensitive drum 13. An LED head 5 for irradiating light upon the photosensitive drum 24 from the rear face side to form a desired electrostatic latent image on the photosensitive drum 24 is disposed on the inner side of the photosensitive drum 24 such that it normally contacts with the inner periphery of the photosensitive drum 24.

A toner unit 3 in which toner powder 2 is accommodated is disposed at a position on the outside of the photosensitive drum 24 corresponding to the LED head 5. A cleaning roll 17 and a developing roll 6 are disposed in the toner unit 3 on the the upstream side and the downstream side of the LED head 5, respectively, in the direction of rotation of the photosensitive drum 24 such that they are positioned in the proximity of the outer peripheral face of the photosensitive drum 24. The cleaning roll 17 is constituted from a magnet roll 18 and a sleeve 19 covering over the outer periphery of the magnet roll 18. A recovery roll 22 is disposed in the proximity of the cleaning roll 16, and a cleaning blade 7 for scraping off toner powder 2 sticking to the outer peripheral face of the cleaning roll 17 is disposed adjacent the recovery roll 22. A transfer unit 10 for transferring a visible toner image developed by the developing roll 6 to a predetermined paper sheet 9 is disposed adjacent the outer periphery of the photosensitive drum 24.

The remaining elements of the electrophotographic printer of the present embodiment are substantially similar to those of the electrophotographic printer of the first embodiment described hereinabove, and overlapping description thereof is omitted herein to avoid redundancy.

Also in the electrophotographic printer of the present embodiment, similarly as in the electrophotographic printer of the embodiment described above, the magnet roll 16 and the sleeve 19 of the cleaning roll 17 are driven to rotate in the opposite directions, and a negative bias voltage is applied to the magnet roll 18 of the cleaning roll 17. Consequently, a magnet brush 21 which holds negative charge therein is formed on the outer peripheral face of the sleeve 19 of the cleaning roll 17, and toner powder 2 remaining on the photosensitive drum 24 is attracted to magnetic carrier particles 20 which form the magnetic brush 21. Then, the toner powder 2 is turned while being held by the magnetic brush 21 of the cleaning roll 17 and is then attracted to the recovery roll 22, whereafter it is scraped off from the recovery roll 22 by the cleaning blade 7 so that it drops downwardly in and recovered by the toner unit 3, thereby completing the cleaning operation.

Meanwhile, the surface of the photosensitive drum 24 from which the toner powder 2 has been removed is contacted with such carrier particles 20 charged with negative charge as described above so that it is charged uniformly with negative charge, thereby entering a condition wherein it can be written by the LED head 5.

Accordingly, also with the electrophotographic printer of the present embodiment, similarly with the the electrophotographic printer of the preceding embodiment, both of a charger and the LED head 5 need not be disposed between the toner unit 3 and the photosensitive drum 24, and consequently, reduction in size of the apparatus and reduction in size of the toner unit 3 can be achieved. Further, since no charger is necessary and the LED head 5 is disposed on the rear face side of the photosensitive drum 21, the degree of freedom in designing can be enhanced remarkably. Further, deterioration of the photosensitive drum 24 can be prevented with certainty and the life of the photosensitive drum 24 can be enhanced remarkably, and besides, cleaning and so forth of the surface of the LED head 5 can be performed very readily.

Figure 6:
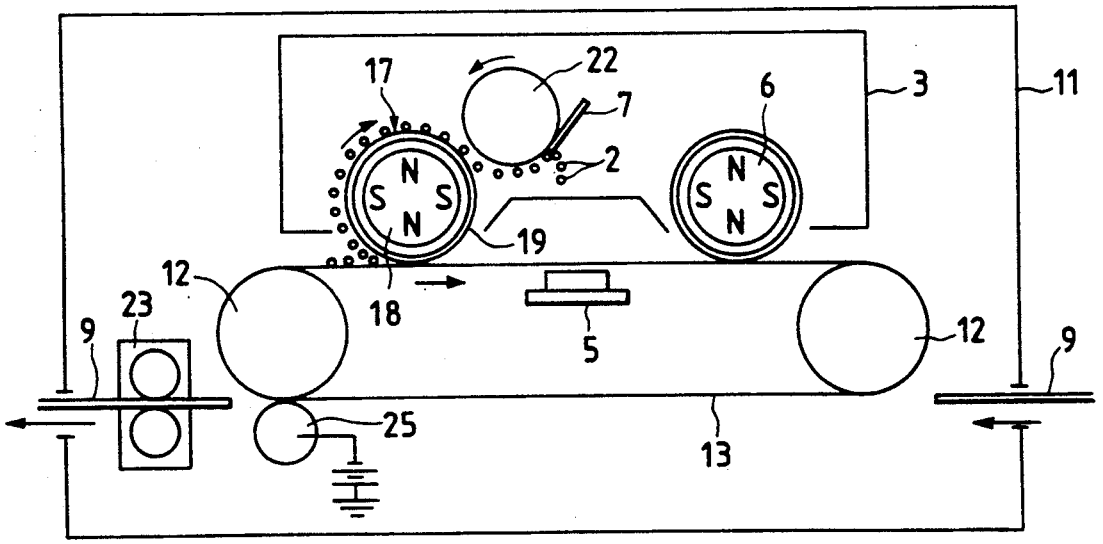
FIG. 6 is a schematic view of a further electrophotographic printer showing a third preferred embodiment of the present invention.
Figure 7:
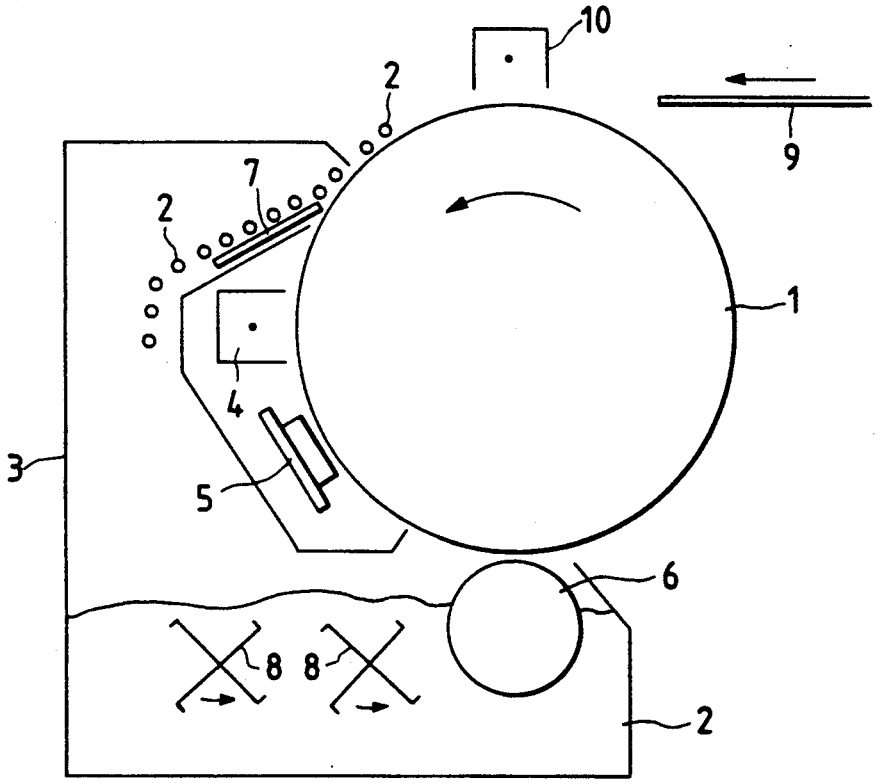
FIG. 7 PRIOR ART
FIG. 7 is a schematic view showing a conventional electrophotographic printer.

FIG. 6 shows a further electrophotographic printer according to a third preferred embodiment of the present invention, which is similar to the electrophotographic printer of the first embodiment described hereinabove except that it includes a transfer unit in the form of a transfer roll 25 to which a bias voltage is applied.

In particular, in the electrophotographic printer of the present embodiment, a toner image formed from toner powder on the photosensitive belt 13 is transferred to a paper sheet 9 by means of the transfer roll 25 to which a bias voltage having a polarity opposite to the polarity of charge of toner powder 2 (for example, a negative polarity when the toner powder employed is chargeable in a positive polarity) is applied.

Accordingly, also the electrophotographic printer of the present embodiment exhibits similar effects to those of the electrophotographic printers of the preceding embodiments. In addition, since no corona discharge is utilized with the transfer unit, generation of ozone gas is eliminated, and consequently, prevention of deterioration of the photosensitive drum 13 becomes further sure. Further, a possible bad influence of ozone gas upon environment is eliminated.

It is to be noted that the present invention is not limited to the embodiments described above and they can be modified variously in accordance with the necessity. For example, a liquid crystal shutter array head, an EL (electro-luminescence) head or a laser scanner other than an LED head may naturally be employed as an optical writing head.

As apparent from the foregoing description, according to the present invention, various effects can be achieved. In particular, since the optical writing head is disposed on the rear face side of the photosensitive member and the cleaning roll is caused to function also as a charger so that such a charger as is necessitated in conventional electrophotographic printers may not be necessary, reduction in the toner unit and the entire apparatus can be achieved. Besides, the removing or mounting direction of the toner unit upon replacement is not limited, and consequently, the degree of freedom in designing can be enhanced remarkably. Furthermore, otherwise possible deterioration of the photosensitive member which may be caused by ozone gas generated by a charger and/or by heat generated by the optical writing head can be prevented with certainty and the life of the photosensitive member can be enhanced remarkably. In addition, since the optical writing head or the like is not disposed between the toner unit and the photosensitive member, cleaning, maintenance and so forth of the surface of the optical writing head can be performed very readily.

Having now fully described the invention, it will be apparent to one of ordinary skill in the art that many changes and modifications can be made thereto without departing from the spirit and scope of the invention as set forth herein.

What is claimed is:

1. An electrophotographic printer, comprising:

a printer body;

a photosensitive member disposed for rotation in said printer body;

a toner unit disposed in the proximity of an outer periphery of said photosensitive member and having toner powder stored therein;

a developing roll disposed in said toner unit for supplying toner powder to a surface of said photosensitive member so that the toner powder may adhere to an electrostatic latent image formed on the surface of said photosensitive member to form a visible toner image;

a cleaning mechanism disposed in said toner unit for removing and recovering remaining toner powder on the surface of said photosensitive member; and an optical writing head disposed on the rear face side of said photosensitive member between said developing roll and said cleaning mechanism for forming an electrostatic latent image on said photosensitive member in response to a printing signal;

wherein said cleaning mechanism includes a magnetic brush having a charge sufficient to attract remaining toner powder on the surface of said photosensitive member thereto and also to charge the surface of said photosensitive member after removal of the remaining toner powder uniformly to a potential with charge.

2. An electrophotographic printer according to claim 1, wherein said cleaning roll includes a magnet roll and a non-magnetic sleeve covering over an outer periphery of said magnet roll.

3. An electrophotographic printer according to claim 2, wherein said magnet roll and said sleeve are driven to rotate in the opposite directions to each other.

4. An electrophotographic printer according to claim 2, wherein said magnet roll and said sleeve are driven to rotate in the same directions but at different speeds from each other.

5. An electrophotographic printer according to claim 1, wherein a bias voltage having a polarity opposite to the polarity of charge of toner powder is applied to said cleaning roll.

6. An electrophotographic printer according to claim 1, wherein said photosensitive member is a photosensitive belt.

7. An electrophotographic printer according to claim 1, wherein said photosensitive member is a photosensitive drum.

8. An electrophotographic printer, comprising:

a photosensitive member disposed for rotation;

a toner unit disposed in the proximity of an outer periphery of said photosensitive member and having toner powder stored therein;

an optical writing head for forming an electrostatic latent image on a surface of said photosensitive member in response to a printing signal;

a developing roll disposed in said toner unit for supplying toner to the surface of said photosensitive member so that the toner powder may adhere to an electrostatic latent image formed on the surface of said photosensitive member to form a visible toner image;

a cleaning roll disposed in said toner unit for removing and recovering remaining toner powder on the surface of said photosensitive member; and a transfer unit for transferring a toner image formed on said photosensitive member to a record medium;

wherein said cleaning roll is disposed on an upstream side of said developing roll measured in the feeding direction of the surface of said photosensitive member, said optical writing head being disposed on the rear face side of said photosensitive member between said cleaning roll and said developing roll; and wherein said cleaning roll includes a magnetic brush having a charge sufficient to attract remaining toner powder on the surface of said photosensitive member thereto and also to charge the surface of said photosensitive member after removal of the remaining toner powder uniformly to a potential with charge.

9. An electrophotographic printer according to claim 8, wherein said cleaning roll includes a magnet roll and a non-magnetic sleeve covering over an outer periphery of said magnet roll.

10. An electrophotographic printer according to claim 8, wherein said transfer unit is a transfer roll to which a bias voltage having a polarity opposite to the polarity of charge of toner powder is applied.

11. An electrophotographic printer according to claim 8, wherein said optical writing head is an LED head.

12. An electrophotographic printer according to claim 8, wherein a bias voltage having a polarity opposite to the polarity of charge of toner powder is applied to said cleaning roll.

13. An electrophotographic printer according to claim 9, wherein said cleaning roll and said sleeve are driven to rotate in the opposite directions to each other.

14. An electrophotographic printer according to claim 9, wherein said cleaning roll and said sleeve are driven to rotate in the same directions but at speeds different from each other.

* * * * *